US006427279B1

(12) United States Patent
White, Jr. et al.

(10) Patent No.: US 6,427,279 B1
(45) Date of Patent: Aug. 6, 2002

(54) BACK WASHING DEVICE

(76) Inventors: Clyde W. White, Jr., 3040 Kennedy St., Columbia; Richard P. White, 503 S. Bonham Rd., Cola, both of SC (US) 29205

( * ) Notice: Subject to any disclaimer, the term of this patent is extended or adjusted under 35 U.S.C. 154(b) by 12 days.

(21) Appl. No.: 09/667,026

(22) Filed: Sep. 21, 2000

(51) Int. Cl.[7] ..... A47K 7/02
(52) U.S. Cl. ..... 15/104.92; 4/606; 601/136
(58) Field of Search ..... 15/104.92; 4/606; 601/136

(56) References Cited

U.S. PATENT DOCUMENTS

| | | | | | |
|---|---|---|---|---|---|
| 3,085,269 | A | * | 4/1963 | Greer | 4/606 X |
| 3,478,369 | A | * | 11/1969 | Ensley | 4/606 |
| 3,548,439 | A | * | 12/1970 | Berst | 15/104.92 |
| 4,053,960 | A | * | 10/1977 | Kingswell | 15/104.92 |
| 4,151,623 | A | * | 5/1979 | Steere | 4/606 X |
| D260,563 | S | | 9/1981 | Walsh, Jr. | D28/63 |
| 4,417,362 | A | * | 11/1983 | Walker | 4/606 |
| 4,696,068 | A | | 9/1987 | Kenner | 4/606 |
| 4,704,759 | A | | 11/1987 | Mesa | 15/160 |
| 4,943,018 | A | | 7/1990 | Glaser et al. | 248/110 |
| 5,239,712 | A | * | 8/1993 | Kinder | 4/606 |
| 5,345,640 | A | * | 9/1994 | Goss | 4/606 X |
| 5,517,705 | A | * | 5/1996 | Jackson | 4/606 |
| 5,628,083 | A | | 5/1997 | Hayes | 15/244.3 |
| 5,774,907 | A | * | 7/1998 | Doggwiler | 4/606 |
| 6,223,379 | B1 | * | 5/2001 | Martin | 15/104.92 |

FOREIGN PATENT DOCUMENTS

| | | | | |
|---|---|---|---|---|
| CH | 666180 | * | 7/1988 | 601/136 |
| DE | 2426432 | * | 5/1974 | 4/606 |

* cited by examiner

*Primary Examiner*—Mark Spisich

(57) ABSTRACT

A back washing device for scrubbing the back of a user. The back washing device includes a housing having a bottom wall, a top wall, a back wall, pair of lateral side walls and a front wall such that a lumen is defined in the housing. The front wall has a plurality of apertures therein. A securing device removably secures the housing to the wall. A scrubbing member is securely attached to and generally covers an outer surface of the front wall. A container, having liquid soap therein, is positioned in the lumen. A hose member is fluidly coupled to the container and abuts an inside surface of the front wall. The hose member has a plurality of apertures therein. A pumping device pumps the liquid soap through the hose member so that the liquid soap enters the scrubbing member. The pumping device is securely attached to the container and extends outward of the housing through the top wall.

7 Claims, 2 Drawing Sheets

BACK WASHING DEVICE

BACKGROUND OF THE INVENTION

1. Field of the Invention

The present invention relates to body washing devices and more particularly pertains to a new back washing device for scrubbing the back of a user.

2. Description of the Prior Art

The use of body washing devices is known in the prior art. More specifically, body washing devices heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 4,696,068; U.S. Pat. No. 5,628,083; U.S. Pat. No. 4,943,018; U.S. Pat. No. 4,704,759; U.S. Des. Pat. No. 260,563.

While these devices fulfill their respective, particular objectives and requirements, the aforementioned patents do not a housing having a bottom wall, a top wall, a back wall, pair of lateral side walls and a front wall such that a lumen is defined in the housing. The front wall has a plurality of apertures therein. A securing means removably secures the housing to the wall. A scrubbing member is securely attached to and generally covers an outer surface of the front wall. A container, having liquid soap therein, is positioned in the lumen. A hose member is fluidly coupled to the container and abuts an inside surface of-the front wall. The hose member has a plurality of apertures therein. A pumping means pumps the liquid soap through the hose member so that the liquid soap enters the scrubbing member. The pumping means is securely attached to the container and extends outward of the housing through the top wall.

In these respects, the back washing device according to the present invention substantially departs from the conventional concepts and designs of the prior art, and in so doing provides an apparatus primarily developed for the purpose of scrubbing the back of a user.

SUMMARY OF THE INVENTION

In view of the foregoing disadvantages inherent in the known types of body washing devices now present in the prior art, the present invention provides a new back washing device construction wherein the same can be utilized for scrubbing the back of a user.

The general purpose of the present invention, which will be described subsequently in greater detail, is to provide a new back washing device apparatus and method which has many of the advantages of the body washing devices mentioned heretofore and many novel features that result in a new back washing device which is not anticipated, rendered obvious, suggested, or even implied by any of the prior art body washing devices, either alone or in any combination thereof.

To attain this, the present invention generally comprises a housing having a bottom wall, a top wall, a back wall, pair of lateral side walls and a front wall such that a lumen is defined in the housing. The front wall has a plurality of apertures therein. A securing means removably secures the housing to the wall. A scrubbing member is securely attached to and generally covers an outer surface of the front wall. A container, having liquid soap therein, is positioned in the lumen. A hose member is fluidly coupled to the container and abuts an inside surface of the front wall. The hose member has a plurality of apertures therein. A pumping means pumps the liquid soap through the hose member so that the liquid soap enters the scrubbing member. The pumping means is securely attached to the container and extends outward of the housing through the top wall.

There has thus been outlined, rather broadly, the more important features of the invention in order that the detailed description thereof that follows may be better understood, and in order that the present contribution to the art may be better appreciated. There are additional features of the, invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new back washing device apparatus and method which has many of the advantages of the body washing devices mentioned heretofore and many novel features that result in a new back washing device which is not anticipated, rendered obvious, suggested, or even implied by any of the prior art body washing devices, either alone or in any combination thereof.

It is another object of the present invention to provide a new back washing device which may be easily and efficiently manufactured and marketed.

It is a further object of the present invention to provide a new back washing device which is of a durable and reliable construction.

An even further object of the present invention is to provide a new back washing device which is susceptible of a low cost of manufacture with regard to both materials and labor, and which accordingly is then susceptible of low prices of sale to the consuming public, thereby making such back washing device economically available to the buying public.

Still yet another object of the present invention is to provide a new back washing device which provides in the apparatuses and methods of the prior art some of the advantages thereof, while simultaneously overcoming some of the disadvantages normally associated therewith.

Still another object of the present invention is to provide a new back washing device for scrubbing the back of a user.

Yet another object of the present invention is to provide a new back washing device which includes a housing having a bottom wall, a top wall, a back wall, pair of lateral side walls and a front wall such that a lumen is defined in the housing. The front wall has a plurality of apertures therein. A securing means removably secures the housing to the wall. A scrubbing member is securely attached to and generally covers an outer surface of the front wall. A container, having liquid soap therein, is positioned in the lumen. A hose member is fluidly coupled to the container and abuts an inside surface of the front wall. The hose member has a plurality of apertures therein. A pumping means pumps the liquid soap through the hose member so that the liquid soap enters the scrubbing member. The pumping means is securely attached to the container and extends outward of the housing through the top wall.

Still yet another object of the present invention is to provide a new back washing device that has an angled front side for better reach the middle of a back.

Even still another object of the present invention is to provide a new back washing device that has liquid soap built in for displacement upon the scrubbing member.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 2:
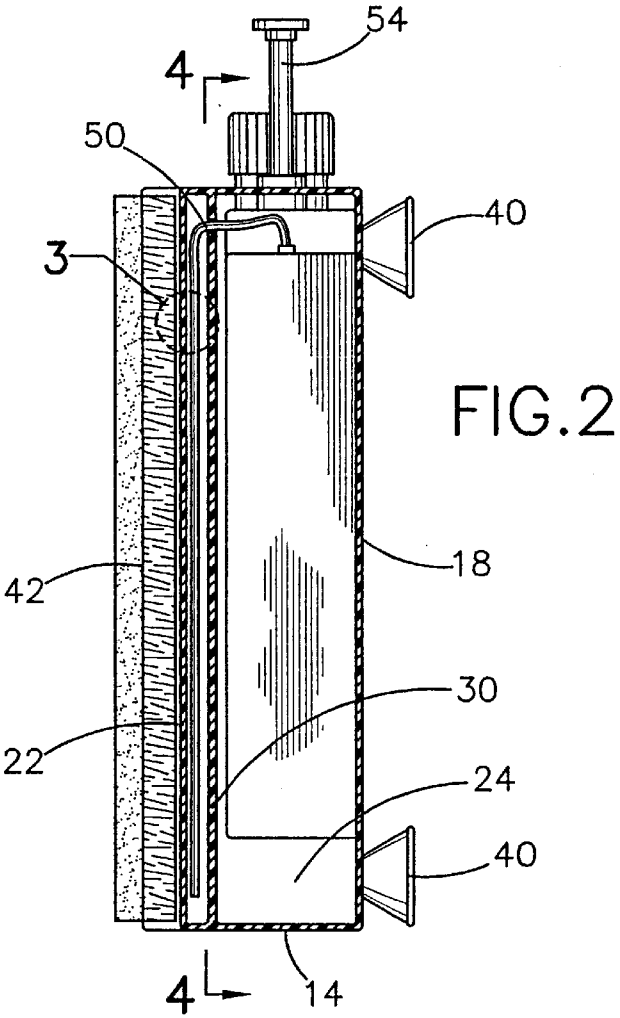
FIG. 2 is a schematic cross-sectional view taken along line 2—2 of the present invention.
Figure 1:
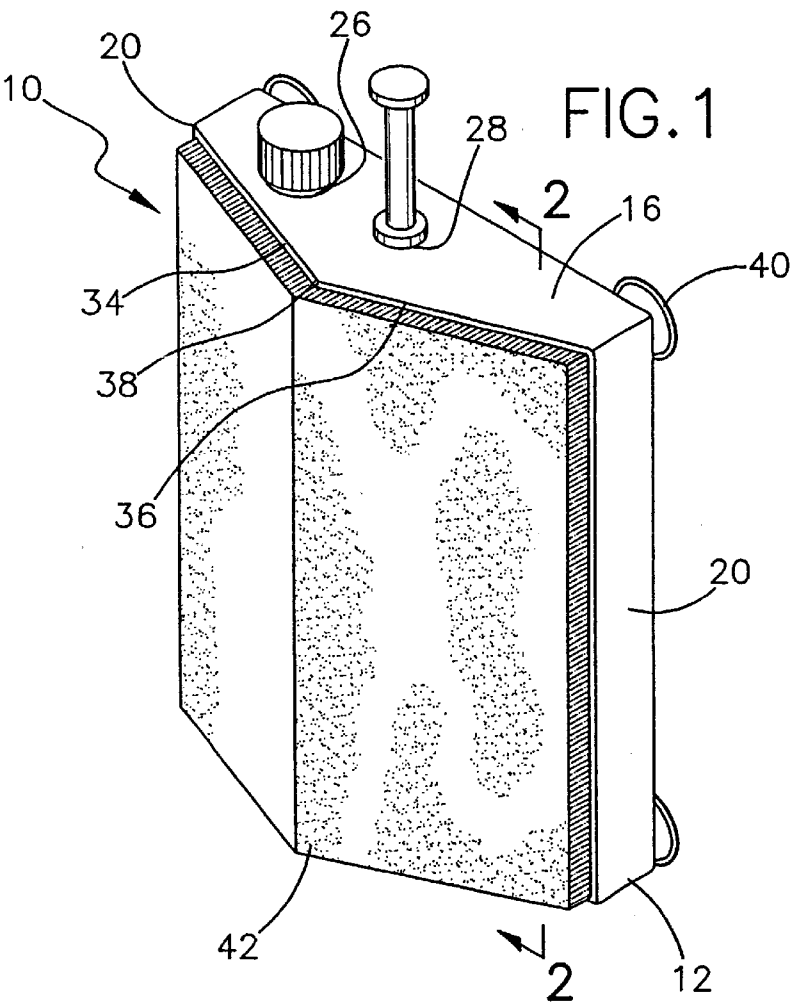
FIG. 1 is a schematic perspective view of a new back washing device according to the present invention.
Figure 3:
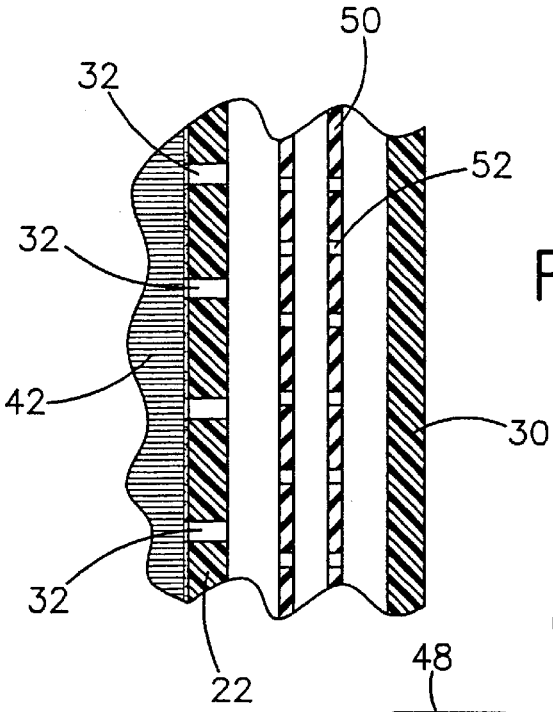
FIG. 3 is a schematic cross-sectional view taken along line 3—3 of the present invention.
Figure 4:
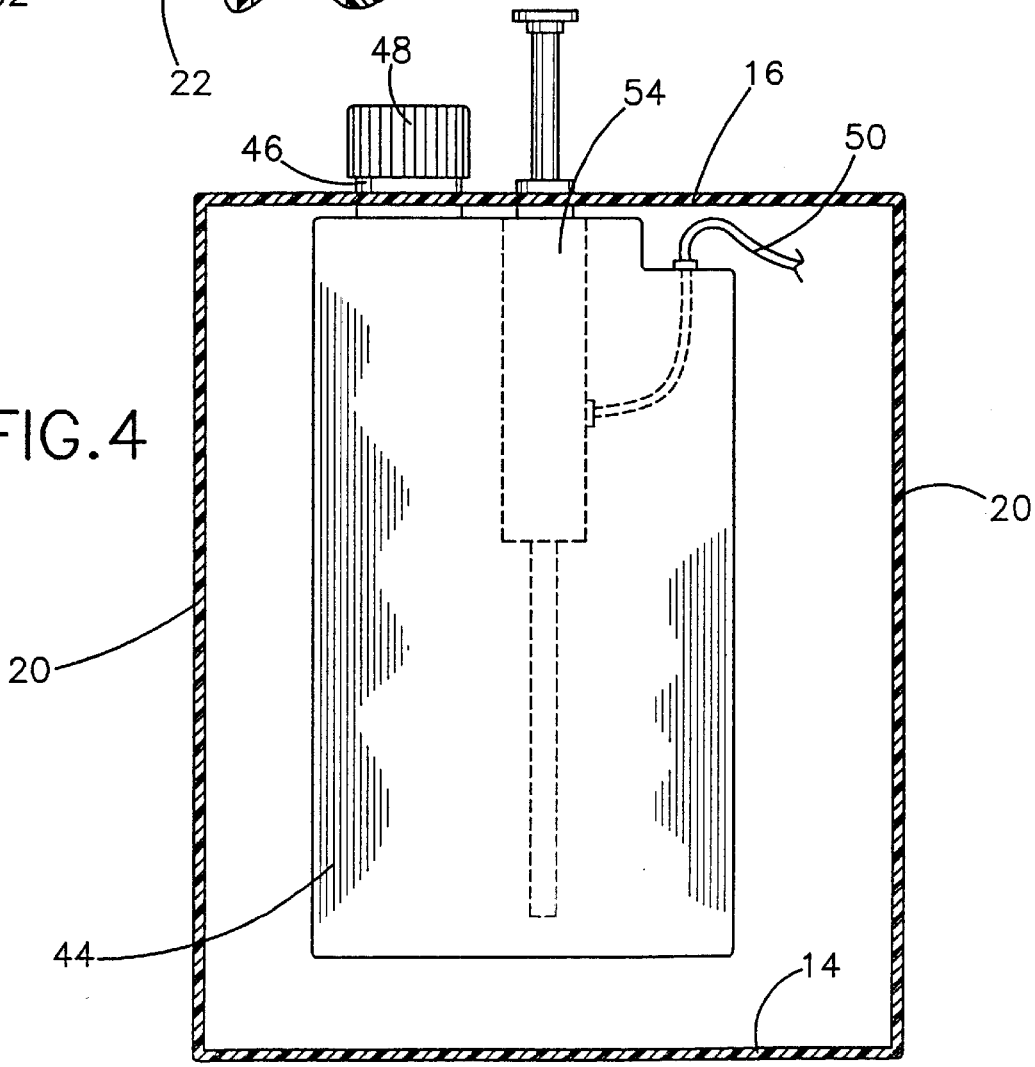
FIG. 4 is a schematic cross-sectional view taken along line 4—4 of the present invention.

With reference now to the drawings, and in particular to FIGS. 1 through 4 thereof, a new back washing device embodying the principles and concepts of the present invention and generally designated by the reference numeral 10 will be described.

As best illustrated in FIGS. 1 through 4, the back washing device 10 generally comprises a housing 12. The housing 12 has a bottom wall 14, a top wall 16, a back wall 18, pair of lateral side walls 20 and a front wall 22 such that a lumen 24 is defined in the housing 12. The top wall 16 has a pair of holes 26, 28 therethrough extending into the lumen 24. An intermediate wall 30 is positioned between the front 22 and back 18 walls. The intermediate wall 30 is positioned relatively nearer the front wall 22 than the back wall 18. The front wall 22 has a plurality of apertures 32 therein. The front wall 22 has a left side 34 and a right side 36 in an angular relationship with each such that a juncture 38 of the left 34 and right 36 sides extends outwardly away from the housing.

A securing means 40 removably secures the housing 12 to a wall. The securing means 40 is securely coupled to the back wall 18 and ideally comprises a plurality of suction cups.

A scrubbing member 42 is securely attached to and generally covers an outer surface of the front wall 22. The scrubbing member 42 is conventional and comprises a plurality of resiliently flexible filaments. Also envisioned is a scrubbing member 42 that is removable from the front wall.

A container 44 is positioned in the lumen 24. The container 44 has an opening therein. An annular lip 46 extends upwardly away from the opening and extends through a first 26 of the holes in the top wall 16. The container 44 preferably has a conventional liquid soap therein. A conventional cap member 48 is removably coupled to the annular lip.

A hose member 50 is fluidly coupled to the container 44. The hose member 50 extends through the intermediate wall 30 and generally is adjacently to and preferably abuts an inside surface of the front wall 22. The hose member 50 has a plurality of apertures 52 therein.

A pumping means 54 pumps the liquid soap through the hose member 50. The pumping means 54 is securely attached to the container 44 and extends outwardly from a second 28 of the holes in the top wall 16. The pumping means 54 is a conventional pump coupled to the hose member 50.

In use, the device 10 is placed on the wall of a shower. The user pumps soap through the hose member 50, which is displaced through the apertures in the hose member 50 and the front wall 22 so that the soap enters the scrubbing member 42. The user then scrubs their back against the scrubbing member. The angled nature of the front wall 22 allows the scrubbing member 42 to reach crevices in the back. The cap member 48 may be removed for filling the container with more liquid soap.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. A back washing device, said device being removably couplable to a wall, said device comprising:

a housing, said housing having a bottom wall, a top wall, a back wall, pair of lateral side walls and a front wall such that a lumen is defined in said housing, said front wall having a plurality of apertures therein;

a securing means for removably securing said housing to the wall;

a scrubbing member, said scrubbing member being securely attached to and generally covering an outer surface of said front wall;

a container, said container being positioned in said lumen, said container having a liquid soap therein;

a hose member, said hose member being fluidly coupled to said container, said hose generally abutting an inside surface of said front wall, said hose member having a plurality of apertures therein; and a pumping means for pumping said liquid soap through said hose member, said pumping means being securely attached to said container and extending outward of said housing through said top wall.

2. The back washing device as in claim 1, wherein said housing further comprises:

an intermediate wall being positioned between said front and back walls, said intermediate wall being positioned relatively nearer said front wall than said back wall; and said hose extending through said intermediate wall.

3. The back washing device as in claim 1, wherein said securing means further comprises:

said securing means being securely coupled to said back wall, said securing means comprising a plurality of suction cups.

4. The back washing device as in claim 1, wherein said scrubbing member comprises:

a plurality of resiliently flexible filaments.

5. The back washing device as in claim 1, wherein said container further comprises:

said container having an opening therein, an annular lip extending upwardly away from said opening and extending through said top wall, a cap member being removably coupled to said annular lip.

6. The back washing device as in claim 1, wherein said housing further comprises:

said front wall having a left side and a right side in an angular relationship with each such that a juncture of said left and right sides extends outwardly away from said housing.

7. A back washing device, said device being removably couplable to a wall, said device comprising:

a housing, said housing having a bottom wall, a top wall, a back wall, pair of lateral side walls and a front wall such that a lumen is defined in said housing, said top wall having a pair of holes therethrough extending into said lumen, an intermediate wall being positioned between said front and back walls, said intermediate wall being positioned relatively nearer said front wall than said back wall, said front wall having a plurality of apertures therein, said front wall having a left side and a right side in an angular relationship with each such that a juncture of said left and right sides extends outwardly away from said housing;

a securing means for removably securing said housing to the wall, said securing means being securely coupled to said back wall, said securing means comprising a plurality of suction cups;

a scrubbing member, said scrubbing member being securely attached to and generally covering an outer surface of said front wall, said scrubbing member comprising a plurality of resiliently flexible filaments;

a container, said container being positioned in said lumen, said container having an opening therein, an annular lip extending upwardly away from said opening and extending through a first of said holes in said top wall, said container having a liquid soap therein, a cap member being removably coupled to said annular lip;

a hose member, said hose member being fluidly coupled to said container, said hose extending through said intermediate wall and generally abutting an inside surface of said front wall, said hose member having a plurality of apertures therein; and a pumping means for pumping said liquid soap through said hose member, said pumping means being securely attached to said container and extending outwardly from a second of said holes in said top wall.

* * * * *